United States Patent [19]

Okita

[11] Patent Number: 5,007,866

[45] Date of Patent: Apr. 16, 1991

[54] TRIMMING/TILTING SYSTEM FOR MARINE PROPULSION UNIT

[75] Inventor: Ryozo Okita, Hamamatsu, Japan

[73] Assignee: Sanshin Industries Co., Ltd., Hamamatsu, Japan

[21] Appl. No.: 416,865

[22] Filed: Oct. 4, 1989

[30] Foreign Application Priority Data

Oct. 4, 1988 [JP] Japan ..... 63-250306

[51] Int. Cl.[5] ..... B63H 21/26

[52] U.S. Cl. ..... 440/61

[58] Field of Search ..... 440/53, 61, 1, 2, 900; 91/519-533, 508

[56] References Cited

U.S. PATENT DOCUMENTS

| | | | |
|---|---|---|---|
| 3,722,455 | 3/1973 | Carpenter | 440/61 |
| 3,799,104 | 3/1974 | Kurling | 440/61 |
| 3,842,789 | 10/1974 | Bergstedt | 440/61 |
| 4,096,820 | 6/1978 | Hall | 440/61 |

FOREIGN PATENT DOCUMENTS 60-234096 11/1985 Japan .

*Primary Examiner*—Joseph F. Peters, Jr.
*Assistant Examiner*—Edwin L. Swinehart
*Attorney, Agent, or Firm*—Ernest A. Beutler

[57] ABSTRACT

A hydraulic tilt and trim system for a marine outboard drive unit for effecting quick tilting-up of the drive unit and slow trimming of the drive unit through a plurality of trim positions. The system includes two fluid motors, preferably of the piston-cylinder type, interposed between the marine vessel and the drive unit for adjusting the tilt and trim of the drive unit. A reversible fluid pump is used to power the fluid motors and communicates with the fluid motors by way of conduits and hoses. The system further includes a selector valve, which is manually or magnetically operated, to control the flow of hydraulic fluid from the pump to the fluid motors. To achieve slow trimming movement of the drive unit, the valve is adjusted so that the pump delivers hydraulic fluid to one fluid chamber of each fluid motor simultaneously while the fluid in the other chamber of each fluid motor is discharged back to the pump. In the quick tilt-up mode, the valve is adjusted so that the pump delivers twice the hydraulic fluid to only one of the fluid motors.

9 Claims, 5 Drawing Sheets

TRIMMING/TILTING SYSTEM FOR MARINE PROPULSION UNIT

BACKGROUND OF THE INVENTION

The invention relates to a tilting and trimming system for an outboard drive unit of a marine vessel. More particularly, the invention relates to an improved hydraulically operated tilting and trimming system adapted for quick tilting up of the drive unit and slow trimming of the drive unit.

As is well known, a variety of hydraulic systems have been employed for achieving tilt and trim movement of a marine outboard drive unit. These systems typically include a reciprocating hydraulic or fluid motor, which is interposed between the transom of the marine vessel and the drive unit for adjusting the tilt and the trim of the outboard drive unit in response to extension and contraction of the fluid motor. The fluid motor is powered by a fluid system that is normally contained within the hull of the marine vessel and may include a reversible electric motor and a reversible fluid pump. In connection with such systems, it is normal practice to include a pressure relief valve or valves in the hydraulic circuitry to the fluid motor so as to relieve pressure in the system and protect the system and drive unit from damage in the event the drive unit collides with a submerged or floating obstacle.

Previous tilt and trim systems have been arranged to provide for both quick tilting movement and slow trimming movement of a drive unit. Some of these systems utilize a manual valve coupled to the gear control mechanism of the drive unit to achieve tilting and trimming by shifting the gears of the drive unit. An example of such a system is set forth in U.S. Pat. No. 3,842,789. Other systems utilize a plurality of pistons and a multitude of valves interconnected within the hydraulic circuitry to achieve tilting and trimming functions. Examples of these systems are set forth in the U.S. Pat. No. 3,799,104 and Japanese Patent No. 60-234096. These systems are inordinately complicated.

Unlike previous systems arranged to provide both quick tilting and slow trimming of an outboard drive unit, the present invention provides a system having a simple construction but capable of performing both quick tilting up movement and slow trimming movement of the drive unit. In one embodiment of the present invention, a manually operated selector valve is provided, adjustable between a first and second position, to slowly trim the drive unit or quickly tilt up the drive unit. In another embodiment of the invention, a magnetically operated selector valve is provided which is electrically linked to the gear throttle control mechanism to effect slow trimming or quick tilting up movement of the drive unit.

SUMMARY OF THE INVENTION

A first embodiment of this invention includes a manually operated selector valve embodied in a hydraulic tilt and trim system for an outboard drive unit mounted on the transom of a marine vessel for effecting quick tilting movement and slow movement between a plurality of trim positions. The system includes a pair of fluid motors extendably connecting the drive unit and transom or stationary part of the drive unit. Each fluid motor has a cylinder housing and a moveable member, typically a piston rod and a piston, which defines a pair of fluid chambers. In accordance with the invention, the system includes a pump for delivering hydraulic fluid from a reservoir to the fluid motors. The pump fluidly communicates with the fluid motors by way of conduits and hoses.

Another embodiment of the invention utilizes a magnetically operated selector valve to achieve quick tilt and slow trim movement of the outboard drive unit.

Both selector valves control the flow of hydraulic fluid from the pump to the fluid motors. When the valves are adjusted for slow trimming, the pump delivers hydraulic fluid to one fluid chamber of each fluid motor while the fluid in the other chamber of each fluid motor is discharged to the pump in response to the movement to the moveable member. When the valves are adjusted for quick tilting up of the drive unit, the pump delivers hydraulic fluid to only one of the fluid motors.

DETAILED DESCRIPTION OF THE PREFERRED EMBODIMENTS

Figure 1:
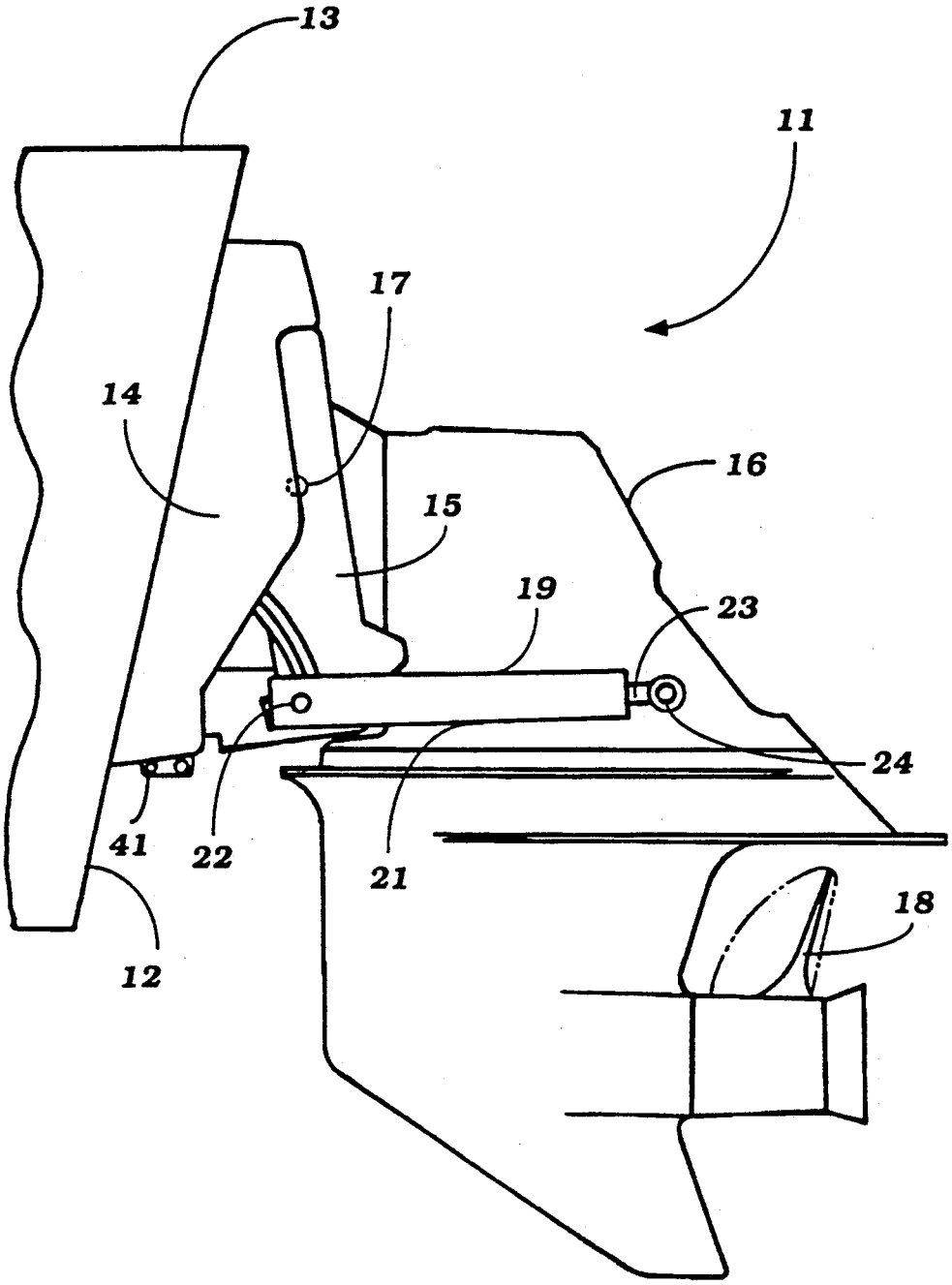
FIG. 1 is a partial side elevational view of a marine vessel having an outboard drive unit constructed in accordance with an embodiment of the invention.

Referring to FIG. 1, an outboard drive unit of an inboard/outboard drive assembly is indicated generally by the reference numeral 11 and is depicted as being attached to the transom 12 of the hull 13 of a marine vessel. The outboard drive unit 11 includes a gimbal housing 14 that is affixed to the transom 12 and which supports a gimbal ring 15 for steering movement about a vertically extending steering axis. An outboard drive housing 16 is pivotally connected to the gimbal ring 15 by means of pivot pins 17 for tilt and trim movement.

An internal combustion engine (not shown) is mounted within the hull 13 and drives a propeller 18 of the outboard drive unit 11 through a conventional forward, neutral, reverse transmission (not shown). The construction of the outboard drive unit 11 per se is not necessary to understand the invention and, as will become apparent, the invention is adaptable for use with an outboard motor or the outboard stern drive portion of an inboard/outboard engine system which are collectively called "outboard drive units" in the Specification and claims.

The invention deals primarily with the hydraulic system for operating the tilt and trim of the outboard drive unit 11. This system comprises first and second linear type fluid motors indicated generally by reference numeral 19 in FIG. 1 and more specifically as 19A and 19B respectively in FIGS. 2 through 5. Each fluid motor 19A and 19B includes a cylinder housing 21A and 21B respectively that is journaled at one end on the gimbal ring 15 by means of a pivot pin 22. Each fluid motor 19A and 19B further includes a piston rod 23A and 23B respectively that extends from the cylinder housing 21A or 21B and is pivotally connected to the side of the outboard drive housing 16 by a pivot pin 24.

Figure 2:
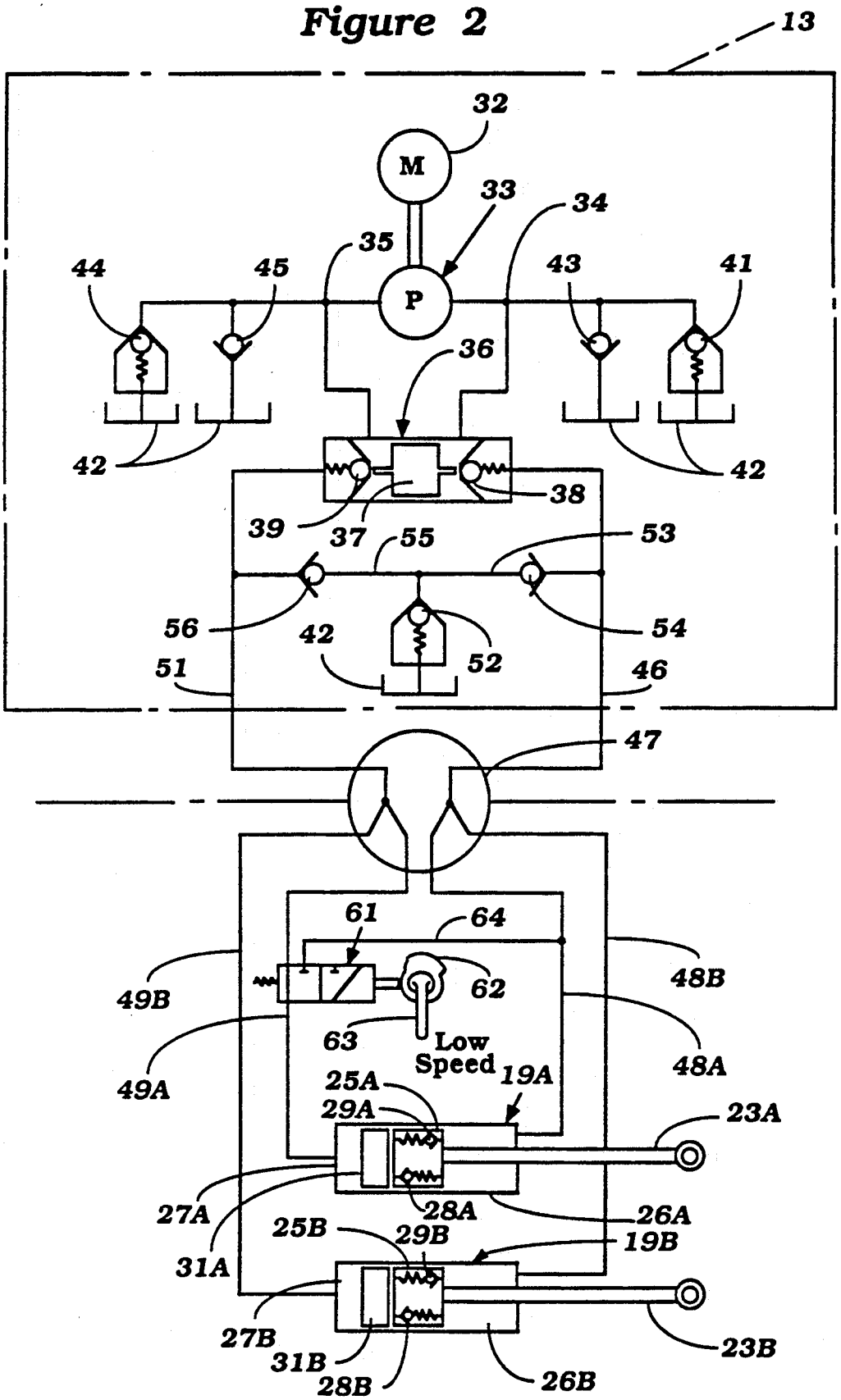
FIG. 2 is a schematic hydraulic circuit diagram of the low speed trimming mode, showing a first embodiment of the present invention.

The hydraulic circuitry for operating the system is illustrated in FIG. 2, wherein the internal details of the fluid motors 19A and 19B are depicted. Each fluid motor 19A and 19B includes a piston 25A and 25B respectively which is connected to the appropriate piston rod 23A or 23B in a known manner. The piston 25A and 25B divide the cylinder housings 21A and 21B respectively into first fluid chambers 26A and 26B respectively and second fluid chambers 27A and 27B respectively. Pressure responsive absorber valves 28A and 28B permit flow from chambers 26A and 26B respectively to chambers 27A and 27B respectively in the event of impact with an underwater obstacle. Pressure responsive check valves 29A and 29B permit return flow once the obstacle has been cleared. Floating pistons 31A and 31B are contained within chambers 27A and 27B respectively and serve to retain the outboard drive housing 16 in a trim adjusted position.

Contained within the hull 13 of the marine vessel 11 is the system for selectively pressuring the chambers 26A, 26B, 27A or 27B to achieve power trim and tilt movement. This system includes a reversible electric motor 32 that drives a reversible fluid pump 33. The pump 33 has a pair of ports 34 and 35 that serve selectively as pressure or return ports depending on whether the outboard drive unit 11 is being trimmed up or trimmed down.

The ports 34 and 35 communicate with a shuttle valve assembly, indicated generally by the reference numeral 36. This assembly includes a shuttle piston 37 and a pair of check valves 38 and 39. The shuttle piston 37 has projections that are adapted to unseat the check valves 38 or 39 under an operation as will be described.

There is provided a pressure responsive relief valve 41 in communication with port 34 that permits flow back to a reservoir 42 in the event a high pressure condition exists in the pumping system. In a like manner a check valve 43 permits return flow to the system for make up purposes. A pressure relief valve 44 communicates the port 35 with the reservoir 42. A check valve 45 permits fluid to flow from the reservoir 42 to the port 35 for make up purposes.

FIG. 2 illustrates the hydraulic circuitry for operating the system in the low speed trimming mode. When the motor 32 and pump 33 are operated so as to deliver hydraulic fluid to and thereby pressurize port 34, the pressure in the shuttle valve assembly 36 will effect movement of the shuttle piston 37 to the left to open the check valve 39. The pressure in the shuttle valve assembly 36 also causes the check valve 38 to unseat and open communicating with a first conduit 46 that extends to a distributor housing 47 that is mounted on the gimbal housing 14 of the outboard drive unit 11. The distributor housing 47 communicates the first conduit 46 with a pair of flexible conduits 48A and 48B that extend to chambers 26A and 26B respectively of fluid motors 19A and 19B. This will effect movement of the pistons 25A and 25B to the left so as to cause trim down operation.

During this operation, fluid is discharged from the chambers 27A and 27B through flexible hoses 49A and 49B respectively to the distributor housing 47 for the return to the shuttle valve 36 through a second conduit 51. The fluid returns through the open check valve 39 to port 35 so as to provide return fluid for the system. A manually operated selector valve 61 having a manual selector 62 and a lever 63 prevents fluid flow from flexible conduit 48A to flexible hose 49A through a bypass conduit 64 when the lever 63 is in the first position, as shown in FIG. 2.

For trim-up operation, the motor 32 and pump 33 are driven in the opposite direction so as to pressurize port 35 and cause the shuttle piston 37 to move to the right opening the check valve 38 so that the port 34 acts as a return port. The fluid pressure in the shuttle valve assembly 36 will open the check valve 39 and then flow through the second conduit 51 and flexible hoses 49A and 49B to pressurize the chambers 27A and 27B of fluid motors 19A and 19B and cause trim-up movement.

When the selector valve lever 63 is in the first position, as shown in FIG. 2, the selector valve 61 prevents fluid flow between flexible conduit 48A and flexible hose 49A through the bypass conduit 64.

The hydraulic system further includes a relief valve 52 and a manual bypass valve assembly positioned in the conduit system so as to relieve the hydraulic pressure in the event an impact is received on the drive housing 16 that is greater than that which may be relieved through the pressure responsive valves 28A, 28B, 29A or 29B. The valve 52 is positioned in the conduit system so that it can relieve impact loads in either direction. This bypass valve assembly includes a conduit 53 that extends from the first conduit 46 to the relief valve 52. The conduit 53 includes check valve 54 that permits flow from the first conduit 46 to the conduit 53 and relief valve 52 but not flow in the opposite direction. A conduit 55 communicates the second conduit 51 with the valve 52. A check valve 56 is provided that permits flow from the second conduit 51 into the conduit 55 and relief valve 52 but not flow in the reverse direction. Thus, high pressure in any of the chambers 26A, 26B, 27A or 27B of the fluid motors 19A and 19B can be relieved through the single relief valve 52.

Figure 3:
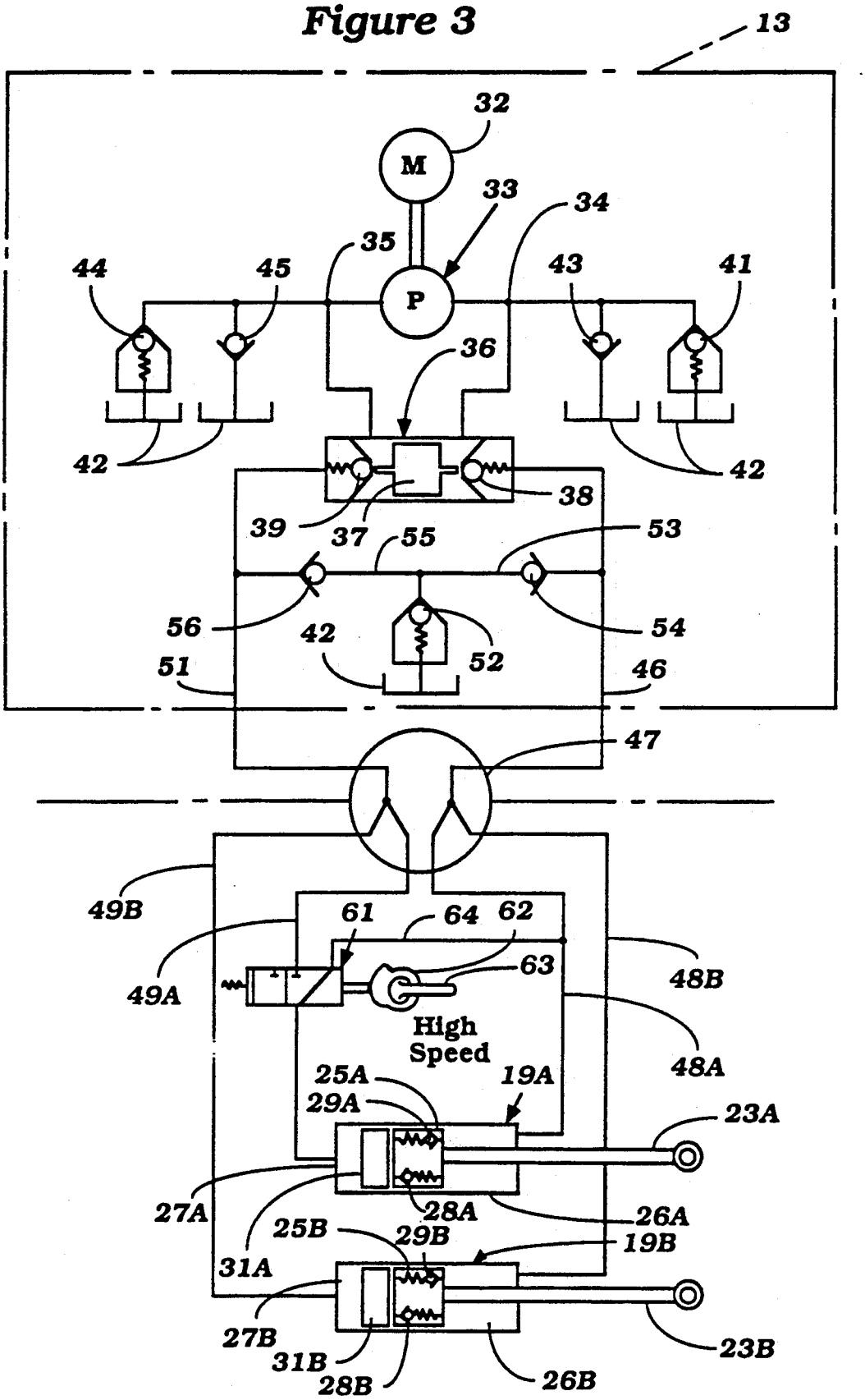
FIG. 3 is a schematic hydraulic circuit diagram showing the high speed tilting mode of the first embodiment.

FIG. 3 shows the hydraulic circuitry for operating the hydraulic system in the high speed tilt-up mode. In this arrangement, the motor 32 and pump 33 are operated so as to deliver hydraulic fluid to port 35 and pressurize port 35. The hydraulic fluid flows into the shuttle valve assembly 36 to effect movement of the shuttle piston 37 to the right causing check valve 38 to open. The pressure in the shuttle valve assembly 36 also causes check valve 39 to unseat and open communication with the second conduit 51. Hydraulic fluid then flows through the distributor housing 47 into flexible hoses 49A and 49B.

At this point the tilting up operating differs from the trimming up operation. In the tilting up operation, the selector valve 61 prevents flow of hydraulic fluid from flexible hose 49A to chamber 27A when the lever 63 is manually adjusted to a second position as shown in FIG. 3.

This causes the hydraulic fluid in flexible hose 49A to "back-up" so that the hydraulic fluid delivered by pump 33 flows through flexible hose 49B thereby doubling the fluid volume delivered to chamber 27B, as compared with the fluid volume delivered to chamber 27B during trim-up operation. Thus, when the selector valve lever 63 is in the second position, as shown in FIG. 3, the pump 33 delivers fluid to only chamber 27B. Since the fluid delivered to chamber 27B is approximately twice that which is delivered during slow trimming operation, a quick outward movement of the piston rod 23B, and thus quick tilting-up of the drive unit is achieved.

Figure 4:
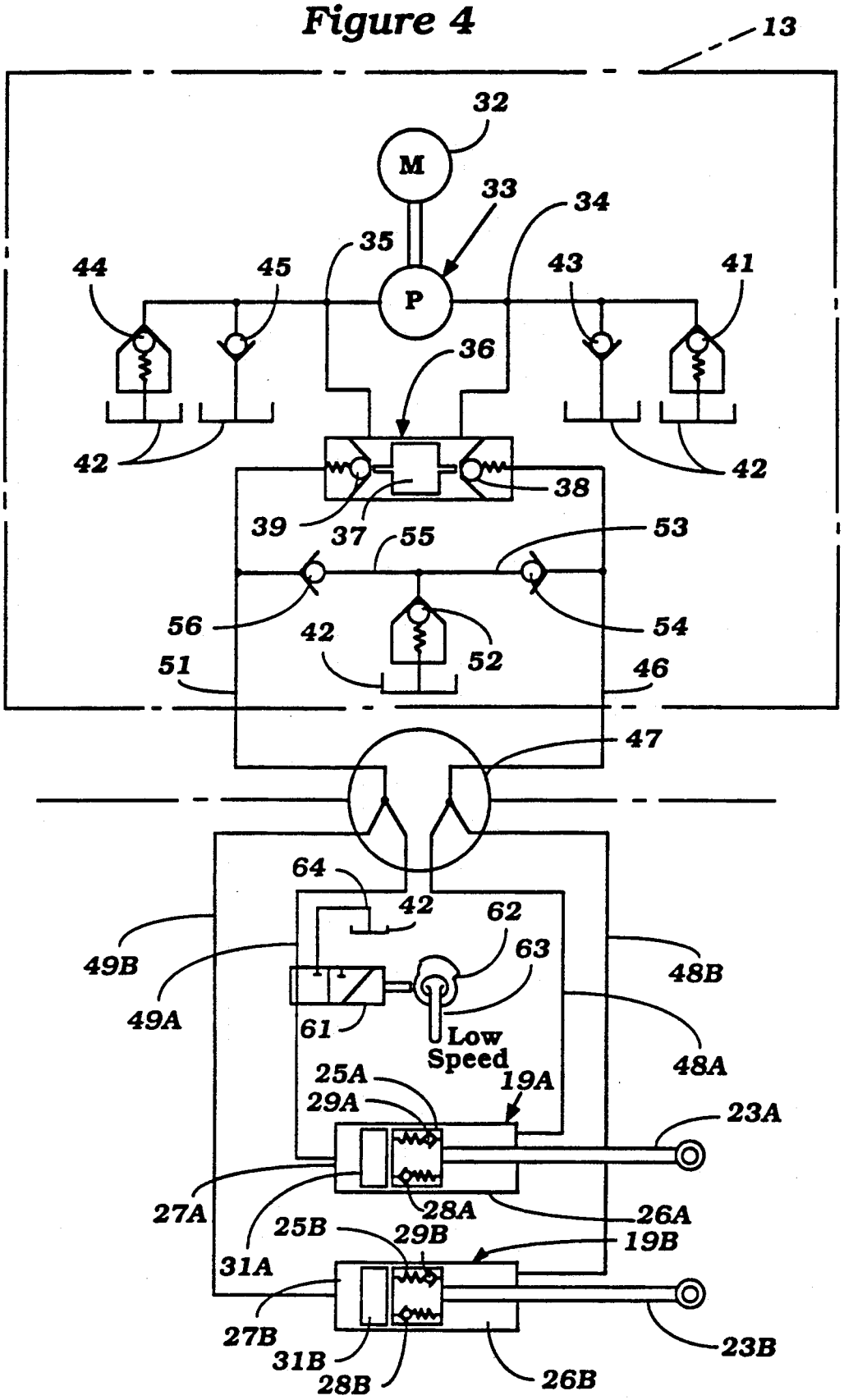
FIG. 4 is a schematic hydraulic circuit diagram of a second embodiment of the present showing the low speed trimming mode.

FIG. 4 shows a second embodiment of the invention in the low speed trimming mode. In this embodiment, the bypass conduit 64 communicates the selector valve 61 with the reservoir 42. To slowly trim the outboard drive unit 11, the system operates as previously described with reference to FIG. 2. When the lever 63 is moved to its second position for high speed operation and quick tilting-up of the drive unit 11, the system is operated as previously described with respect to FIG. 3.

Figure 5:
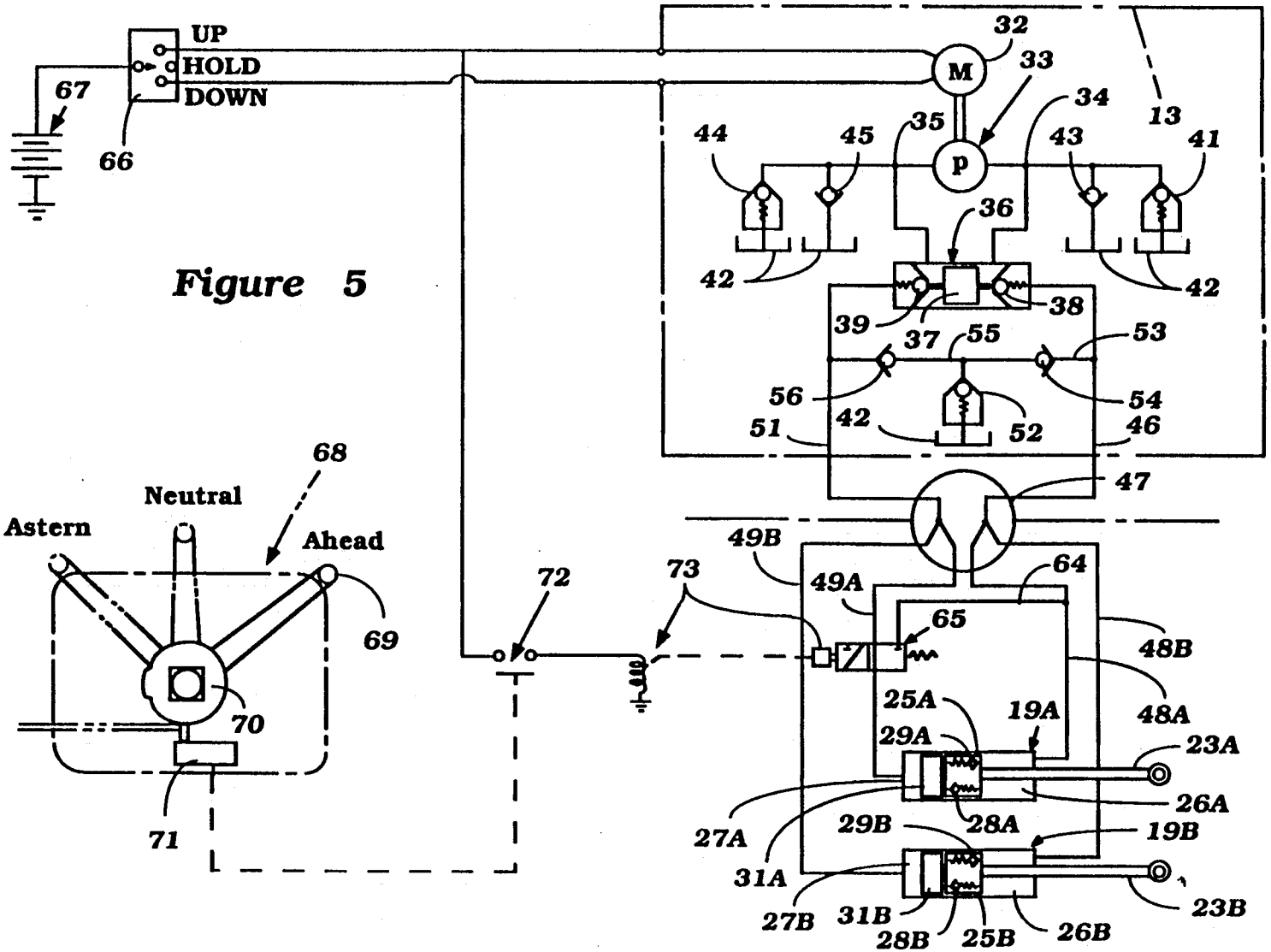
FIG. 5 is a schematic hydraulic circuit diagram of a third embodiment of the invention showing a magnetically operated selector valve in the low speed trimming mode.

Referring to FIG. 5, a third embodiment of the hydraulic tilt and trim system is shown with a magnetically operated selector valve 65. In this embodiment, the system further includes a manually operated switch 66 in circuit with a battery 67 and the motor 32 for operating the motor 32.

In this embodiment, the magnetically operated selector valve 65 includes a solenoid and a solenoid winding 73 shown displaced in FIG. 5. A gear-throttle control mechanism 68 is used to adjust the selector valve 65 between a first and second position for slow trimming and quick tilting of the drive unit 11. The control mechanism 68 includes an adjustable control lever 69 for operating the drive unit 11 in forward, reverse or neutral, and a casing member 70 secured to the control lever 69 at its pivot point. Movement of the control lever 69 between the forward, reverse and neutral positions effects movement of the magnetically operated selector valve 65 as hereinafter described. The control mechanism 68 is linked to the selector valve 65 through a limit switch 71 which has a pair of electrical contacts 72, shown displaced in FIG. 5, for opening and closing the circuit between the switch 66 and the selector valve 65. The position of the switch 71 is controlled by the position of the control lever 69.

When the control lever 69 is moved to a forward or reverse position, a cam on the casing member 70 releases the switch 71 so that the circuit between the switch 66 and selector valve 65 is open as shown in FIG. 5. When the control lever 69 is in forward or reverse, the selector valve 65 is in the first or trim adjusted position. The system is now arranged for slow trimming of the drive unit 11.

To trim up the drive unit 11, the switch 66 is adjusted to the "up" position so that current flows from the battery 67 to drive the motor 32 so as to pressurize port 35. To trim down the drive unit 11, the switch 66 is adjusted to the "down" position to drive the motor 32 in the opposite direction to pressurize port 34. The switch 66 also includes a "hold" position wherein the circuit between the battery 67 and the motor 32 is open so that no current flows to the motor 32. The "hold" position is used to maintain the drive unit 11 in its present trim adjusted position.

For slow trimming of the drive unit 11, the magnetically operated selector valve 65 controls the flow of hydraulic fluid through the system as previously described with reference to the manually operated selector valve 61 in FIG. 2.

Quick tilting up of the drive unit 11 can be achieved when the control lever 69 of the gear-throttle control mechanism 68 is in the neutral position. When the control lever 69 is in that position, the cam on casing member 70 depresses switch 71 so that its contacts close the circuit between the switch 66 and the selector valve 65. To achieve quick tilt up of the drive unit 11, the switch 66 is moved to the "up" position to drive the motor 32 so as to pressurize port 35 and to close the circuit between the battery 67 and the solenoid winding 73 of the selector valve 65. Current flows from the battery 67 through switches 66 and 71 to energize the solenoid winding 73 causing the selector valve 65 to move to its second or tilt adjusted position.

The hydraulic fluid flows through the system as previously described with reference to FIG. 3. The pump 33 delivers twice the amount of fluid to chamber 27B of fluid motor 19B but does not deliver any fluid to chamber 27A of fluid motor 19A to effect quick tilt up of the drive unit 11.

The relief valve 52 and manual bypass valve assembly shown in FIG. 5 operate here in the same manner as previously described.

Although several embodiments of the invention have been described, various changes or modifications may be made in the embodiments without departing from the spirit and scope of the invention as defined by the appended claims.

I claim:

1. A hydraulic tilt and trim system for an outboard drive unit mounted on the transom of a marine vessel for tilting movement of the drive unit and movement between a plurality of trim positions, comprising first and second fluid motors each adapted to effect tilting and trimming movement and each connected to said drive unit and said transom, said fluid motors having cylinder housings and moveable members defining first and second fluid chambers in each fluid motor, a pump for delivering hydraulic fluid to said fluid motors, and a selector valve for effecting quick tilting-up movement of the drive unit by permitting hydraulic fluid to flow to only one of said fluid motors and for effecting slow trimming movement of the drive unit between a plurality of trim positions by permitting hydraulic fluid to flow simultaneously to both of said fluid motors.

2. A hydraulic tilt and trim system as recited in claim 1, wherein said selector valve is manually operated.

3. A hydraulic tilt and trim system as recited in claim 2, wherein said selector valve comprises a manual selector and a lever adjustable between a first and second position.

4. A hydraulic tilt and trim system as recited in claim 3, wherein, when said lever is in said first position, said pump delivers hydraulic fluid to one of said fluid chambers in each of said fluid motors, the fluid in the other of said fluid chambers in each of said fluid motors being discharged to said pump in response to the movement of said moveable members to slowly trim the drive unit between a plurality of trim positions.

5. A hydraulic tilt and trim system as recited in claim 4, wherein, when said lever is in said second position, said pump delivers hydraulic fluid to said second fluid chamber of one of said fluid motors only to quickly tilt-up the drive unit.

6. A hydraulic tilt and trim system as recited in claim 1, wherein said selector valve is magnetically operated.

7. A hydraulic tilt and trim system as recited in claim 6, wherein said selector valve is adjustable between a first and second position.

8. A hydraulic tilt and trim system as recited in claim 7, wherein, when said lever is in said first position, said pump delivers hydraulic fluid to one of said fluid chambers in each of said fluid motors, the fluid in the other of said fluid chambers in each of said fluid motors being discharged to said pump in response to the movement of said moveable members to slowly trim the drive unit between a plurality of trim positions.

9. A hydraulic tilt and trim system as recited in claim 8, wherein, when said lever is in said second position, said pump delivers hydraulic fluid to said second fluid chamber of one of said fluid motors only to quickly tilt-up the drive unit.

* * * * *